US008914991B2

(12) United States Patent
Jackson

(10) Patent No.: US 8,914,991 B2
(45) Date of Patent: Dec. 23, 2014

(54) DRYER TENNIS SHOE STICKER

(76) Inventor: Marvin Lee Jackson, Los Angeles, CA (US)

( * ) Notice: Subject to any disclaimer, the term of this patent is extended or adjusted under 35 U.S.C. 154(b) by 0 days.

(21) Appl. No.: 13/562,413

(22) Filed: Jul. 31, 2012

(65) Prior Publication Data

US 2014/0144039 A1 May 29, 2014

Related U.S. Application Data

(63) Continuation-in-part of application No. 12/798,826, filed on Jun. 11, 2010, now abandoned.

(51) Int. Cl.
*F26B 11/00* (2006.01)
*F26B 25/08* (2006.01)
*A47L 23/20* (2006.01)

(52) U.S. Cl.
CPC ..... *F26B 25/08* (2013.01); *A47L 23/205* (2013.01)
USPC ..... 34/600

(58) Field of Classification Search
USPC ..... 34/90, 100, 104, 105, 595, 600, 610; 68/5 C, 5 R, 19, 20
See application file for complete search history.

(56) References Cited

U.S. PATENT DOCUMENTS

| | | | | |
|---|---|---|---|---|
| 4,702,016 | A * | 10/1987 | Grigsby et al. | 34/499 |
| 4,813,641 | A * | 3/1989 | Wilson | 248/206.2 |
| 4,907,351 | A * | 3/1990 | Hirai | 36/42 |
| 5,024,408 | A * | 6/1991 | Magee | 248/206.5 |
| 5,220,734 | A * | 6/1993 | Carver | 34/600 |
| 5,623,769 | A * | 4/1997 | Hayden | 34/61 |
| 6,067,729 | A * | 5/2000 | Willis | 34/499 |
| 6,374,509 | B1 * | 4/2002 | Jackson et al. | 34/106 |
| 7,591,084 | B2 * | 9/2009 | Santa Ana | 36/100 |
| 8,499,955 | B2 * | 8/2013 | Vazquez et al. | 220/4.22 |
| 2004/0107604 | A1 * | 6/2004 | Ha | 36/97 |
| 2009/0300934 | A1 * | 12/2009 | Hesse et al. | 34/106 |

* cited by examiner

*Primary Examiner* — Steve M Gravini

(57) ABSTRACT

I have invented a partially magnetic apparatus (2) that will consist of stretchable band (80) and a rectangular rod (14) is to be inserted into the upper lacing area of the athletic shoe (3) width wise magnetically attaching athletic shoe (3) to dryer's drum (55) while dryer is in motion.

3 Claims, 4 Drawing Sheets

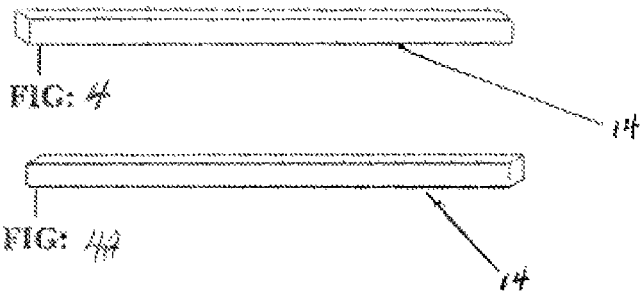
FIG: 4
FIG: 4A
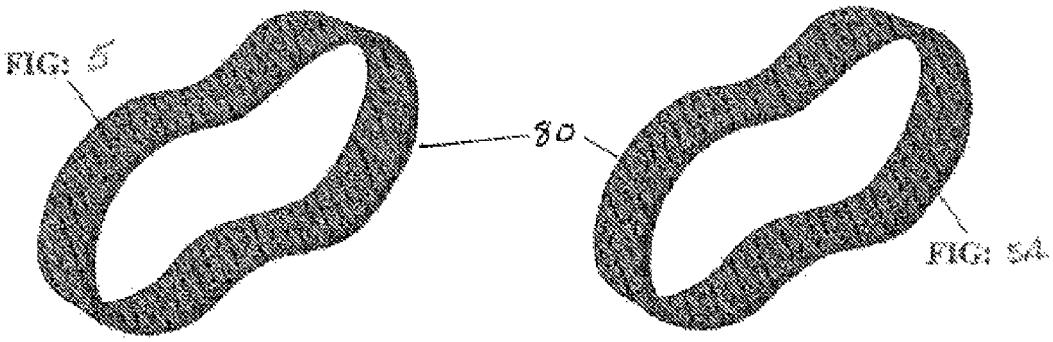
FIG: 5
FIG: 5A

DRYER TENNIS SHOE STICKER

This application is a continuation in part of Ser. No. 12/798,826 filed Jun. 11, 2010 now abandoned.

BACKGROUND OF THE INVENTION

For the better part of the 20$^{th}$ century, athletic shoes have been in use all over the world. Most households have at least one pair. They require little maintenance, and only require washing and drying every so often. Laundering athletic shoes requires nothing special they can be air-dried or put in the dryer.

However, when using a dryer, shoes tumble and bounce loudly, creating a noisy nuisance and potentially causing damage to the dryer and shoe. For this reason, most people prefer to air-dry their athletic shoes, which can take a long time.

I believe there is a need for a device that allows the drying of athletic shoes in a laundry dryer without creating excess noise or risking damage.

BRIEF SUMMARY OF THE INVENTION

The invention includes a magnetic apparatus having a center portion with flat upper and bottom surfaces and rectangular casings at the opposite ends. The magnetic apparatus aligns with the longitudinal axis of an athletic shoe, a band and a rectangular rod for keeping the mouth area of an athletic shoe open during the drying process. The apparatus has opposite ends, along the longitudinal axis, that bend upwards towards the sole of the athletic shoe on each end of the magnet apparatus with the rectangular casings having with permanent magnets attached thereto so that the apparatus may be attached to a laundry dryer drum. In use, the magnetic apparatus is to be placed on the sole of a tennis shoe or athletic shoe in the longitudinal direction and attached thereto by use of a stretchable band that encircles both the center mouth area of the tennis shoe and the magnetic apparatus. The magnetic apparatus is to be magnetically attached to the curvature of a dryer drum. A rectangular rod is placed in the upper lacing area of the shoe lengthwise to keep the upper mouth area of the shoe open for superior drying results. When drying is complete, simply remove shoe and apparatus from dryer drum with caution.

Figure 1:
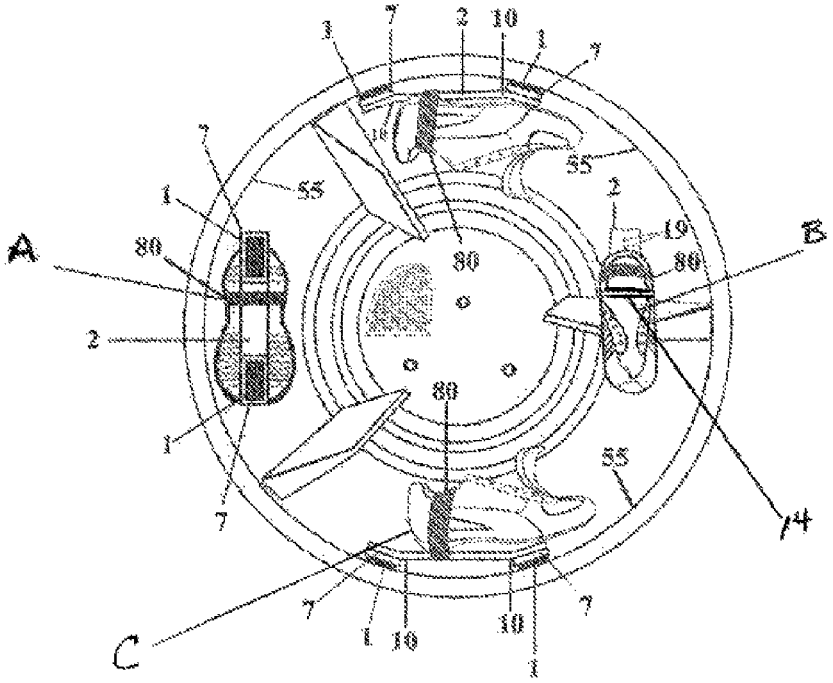
FIG. 1 is a view of partly magnetic apparatus 2 is a view of a shoe stuck to dryer drum with band 80.

Position A in FIG. 1 shows stretchable band 80 around bottom 13 of apparatus 2 and shoe.

Position B in FIG. 1 shows rectangular rod 14 in upper mouth area of the shoe, with the band around the center mouth area of shoe and the magnetic apparatus.

Position C in FIG. 1 shows magnetic apparatus 2 and the shoe stuck to dryer drum with band 80.

Figure 2:
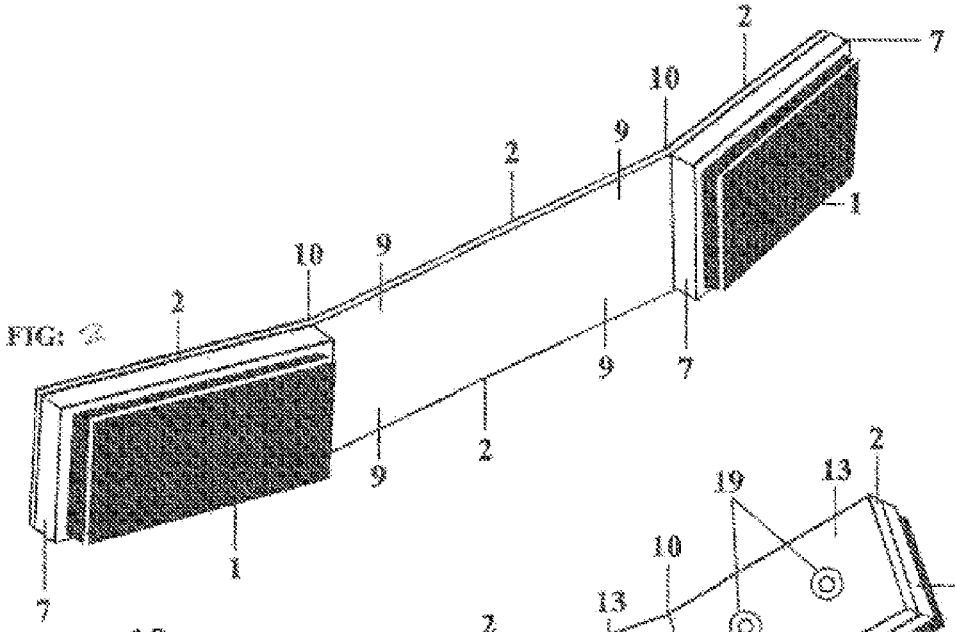
Figure 2A:
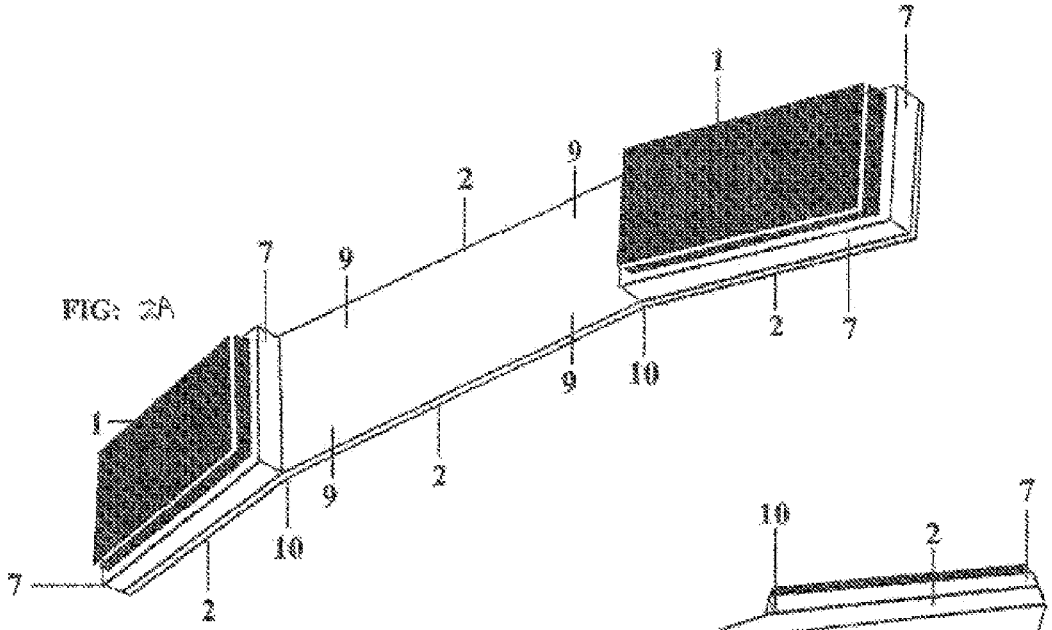
Figure 2B:
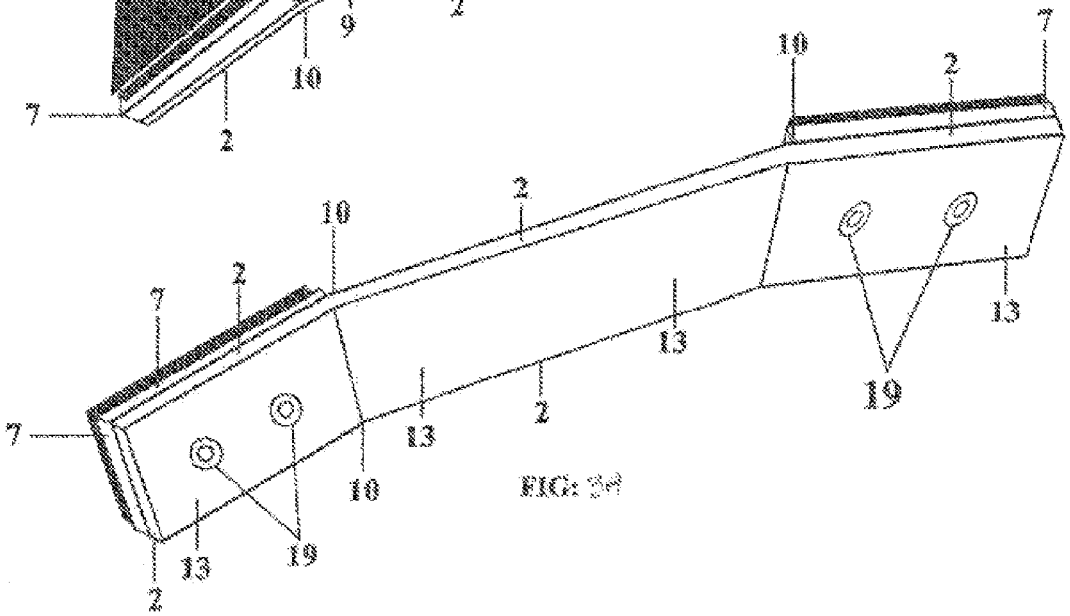

FIG. 2 and FIG. 2A is a side and bottom 9 and back and front view of magnetic apparatus 2 with each opposite bottom end bent upwards.

Figure 3:
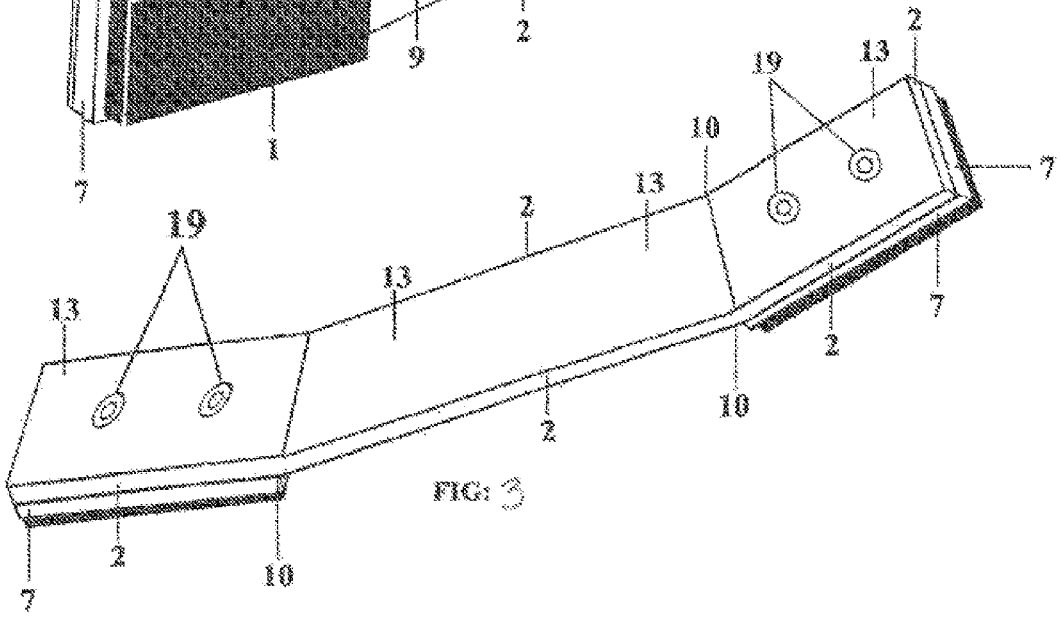

FIG. 3 and FIG. 3A is an upper view of apparatus 2 bent upward on each opposite end and also a back and front and side view.

FIG. 4 and FIG. 4A is a view of the rectangular rod.

FIG. 5 and FIG. 5A is a view of stretchable band 80.

DETAILED DESCRIPTION OF THE INVENTION

FIG. 1 illustrates a conventional laundry dryer 55 with the plurality of magnetic apparatus 2 individually attached to athletic shoes 3. Magnetic apparatus 2 having a center portion with flat upper surface 13 and flat bottom surface 9, rectangular casings 7, as clearly shown in FIGS. 1, 2 and 3, that align with the longitudinal axis of an athletic shoe 3, a band 80 (FIG. 1, Positions A and C and FIG. 5) and a rectangular rod 14 (FIG. 1, Position B and FIG. 4) for keeping the mouth area of an athletic shoe 3 open during the drying process, see FIG. 1, Position B. The magnetic apparatus 2 has casings 7, along the longitudinal axis, that bend upwards towards the athletic shoe 3 when the magnetic apparatus 2 is attached to an athletic shoe 3. Each end of the magnetic apparatus having a permanent magnet 1 attached on the respective opposite ends of the respective casings. The magnets 1 are used to attach the apparatus 2 and corresponding athletic shoe 3 to a conventional laundry dryer 55.

In use, the apparatus 2 is placed on the bottom center of a tennis shoe or athletic shoe 3 along the longitudinal axis by use of a stretchable band 80 that encircles the center mouth area of a tennis shoe 3 and the magnetic apparatus 2. The magnetic apparatus 2 is to be magnetically attached, via magnets 1, to the curvature of a dryer drum 55, see FIG. 1, Position C. A rectangular rod 14 is placed in the upper lacing area of the shoe lengthwise to keep the upper mouth area of the shoe 3 open for superior drying results. The conventional dryer is operated in the conventional manner with the apparatus 2 and shoe 3 attached as described above until the shoe is dried. When drying is complete, simply remove shoe and apparatus from dryer drum with caution.

The magnetic apparatus 2 while being illustrated as rectangular may be embodied in additional shapes. Apparatus 2 and casing 7 can be attached by rivets 19. Apparatus 2 and casing 7 can be made of all solid material and may be slightly flexible or not and made from such materials such as wood, fiberglass, plastic, and rubber. Casing 7 can be integrated into apparatus 2 as a single piece. Apparatus 2 will have a length of 9 to 14 inches between magnets 1 and casing 7 areas. The area between the casing 7 and magnet 1 will have a thickness of 0.25 mm to 1½ mm. Where casing 7 and magnet 1 are located and apparatus 2 combined will have a thickness of ½ to 1 inch. Apparatus 2 will have a width of ½ to 1 inch. Rivets 19 can also be made of all solid non-flexible materials. Rod 14 can be made of all solid materials that are non-flexible. Rod can be spiked or not. Rod 14 will have a length of 1 to 6 inches, a thickness of ½ mm to 1 mm, a width of ½ to 1 mm. Stretchable band 80 will have a length of 1 to 6 inches, a thickness of ½ mm to 1 mm, and a width of ½ to 1 inch. Band 80 can be made of all stretchable or non-stretchable fabrics. Rectangular magnets 1 will be wedged down into rectangular casings 7 with powerful heat-resistant super glue. Magnet 1 can be made of all powerful magnetic materials such as ceramic and metallic magnets 1. Magnetic apparatus 2 and casing 7 can be made of metal. Rod 14 can be partly rectangular or other shapes and spiked on each opposite end or not. When in an operative position adjacent to an athletic shoe, apparatus 2 will have ends that are slightly bent upwards on each opposite end 10 towards the sole of the athletic shoe. Apparatus 2 will be rectangular and can also be formed in other shapes. Apparatus 2 will, have a flat upper surface 13 and a flat bottom surface 9. Rivets 19 can also be slightly, flexible or not flexible.

What is claimed is:

1. An athletic shoe dryer comprising:

a magnetic apparatus having a center portion with flat upper and flat bottom surfaces, the magnetic apparatus having a longitudinal axis and at each opposite end of the magnetic apparatus a casing is formed which is bent outward from the flat bottom surface with magnets attached to the casing such that when the magnetic apparatus in the operative position positioned against the sole of an athletic shoe, the magnet attached to the casing is engageable with a conventional dryer drum;

a band when in operative position encircling both the magnetic apparatus and the athletic shoe such that the athletic shoe so that the magnetic apparatus and the athletic shoe are securely joined together; and a rectangular rod when positioned in operative position being placed in the upper lacing area of the athletic shoe to keep the upper mouth area of the athletic shoe open for during the drying process.

2. An athletic shoe dryer according to claim 1 wherein said band is stretchable.

3. An athletic shoe dryer according to claim 1 wherein said dryer include rivets attaching magnet to magnetic apparatus.

* * * * *